US006672105B1

(12) United States Patent
Sills

(10) Patent No.: US 6,672,105 B1
(45) Date of Patent: Jan. 6, 2004

(54) FINGER RING FIT ADJUSTER

(75) Inventor: Arthur A. Sills, 7229 E. Shore Rd., Traverse City, MI (US) 49686

(73) Assignee: Arthur A. Sills, Suttons Bay, MI (US)

( * ) Notice: Subject to any disclaimer, the term of this patent is extended or adjusted under 35 U.S.C. 154(b) by 0 days.

(21) Appl. No.: 09/940,839

(22) Filed: Aug. 28, 2001

(51) Int. Cl.[7] ..... A44C 9/02
(52) U.S. Cl. ..... 63/15.6; 63/15.5; 63/15.65
(58) Field of Search ..... 63/15.5, 15.6, 63/15.65; 277/605, 646; 285/96, 97

(56) References Cited

U.S. PATENT DOCUMENTS

| | | | | |
|---|---|---|---|---|
| 274,193 | A | 3/1883 | Henrich | |
| 2,523,716 | A | * 9/1950 | Parr | 277/605 |
| 2,615,314 | A | 10/1952 | Axel | |
| 2,745,265 | A | 5/1956 | Grafstein | |
| 2,745,266 | A | 5/1956 | Grafstein | |
| 3,022,648 | A | * 2/1962 | Thaler | 63/15 |
| 3,150,505 | A | 9/1964 | Olson | |
| 3,214,939 | A | 11/1965 | Monahan | |
| 3,237,426 | A | 3/1966 | Doering | |
| 3,353,749 | A | * 11/1967 | Lahaug | 239/154 |
| 3,360,959 | A | 1/1968 | Schechter et al. | |
| 3,465,544 | A | 9/1969 | Tucker | |
| 3,483,718 | A | 12/1969 | Lodrini | |
| 3,486,772 | A | * 12/1969 | Elsner | 285/96 |
| 3,590,598 | A | 7/1971 | Leone | |
| 3,603,109 | A | 9/1971 | Virtanen | |
| 3,901,045 | A | 8/1975 | Ballester | |
| 4,129,999 | A | 12/1978 | Shelton | |
| 4,215,556 | A | 8/1980 | Mroz | |
| 4,223,541 | A | 9/1980 | Martinez | |
| 4,377,079 | A | 3/1983 | Krueger | |
| 4,471,634 | A | 9/1984 | Kaplan | |
| 4,480,447 | A | 11/1984 | Lodrini | |
| 4,526,016 | A | 7/1985 | Cercone | |
| 4,786,087 | A | * 11/1988 | Thewlis et al. | 285/97 |
| 4,999,932 | A | 3/1991 | Grim | |
| 5,031,246 | A | 7/1991 | Kronenberger | |
| 5,155,864 | A | 10/1992 | Walker et al. | |
| 5,186,023 | A | 2/1993 | Goldberg | |
| 5,253,491 | A | 10/1993 | Buontempo et al. | |
| 5,636,531 | A | 6/1997 | Miller | |
| 5,655,315 | A | 8/1997 | Mershon | |
| 5,669,241 | A | 9/1997 | Kohl | |
| 5,943,882 | A | 8/1999 | Erb | |
| 6,003,334 | A | 12/1999 | Miller | |

* cited by examiner

*Primary Examiner*—Andrea Chop
(74) *Attorney, Agent, or Firm*—Reising, Ethington, Barnes, Kisselle & Learman, P.C.

(57) ABSTRACT

A tubular bladder has an outside wall connected to an inside surface of a finger passage through a band of a finger ring. An inside wall of the bladder is integral with the outside wall and forms a gas chamber. A passage connects the gas chamber to a source of air. Increasing air in the gas chamber reduces the diameter of the finger passage. Reducing the quantity of air in the gas chamber increases the diameter of the finger passage. A valve can be provided to meter air into and out of the bladder. If the bladder is resilient and tends to expand the area of the gas chamber, an air passage can let air into and out of the bladder.

15 Claims, 3 Drawing Sheets

FIG - 1
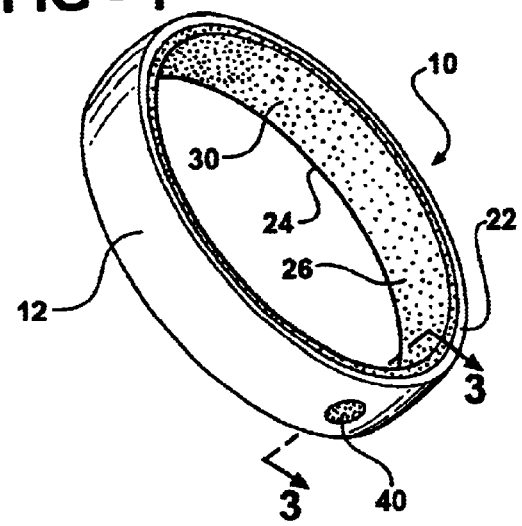
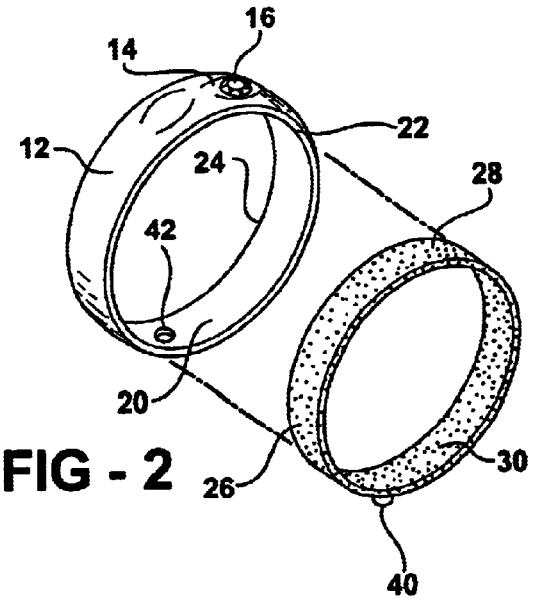
FIG - 2
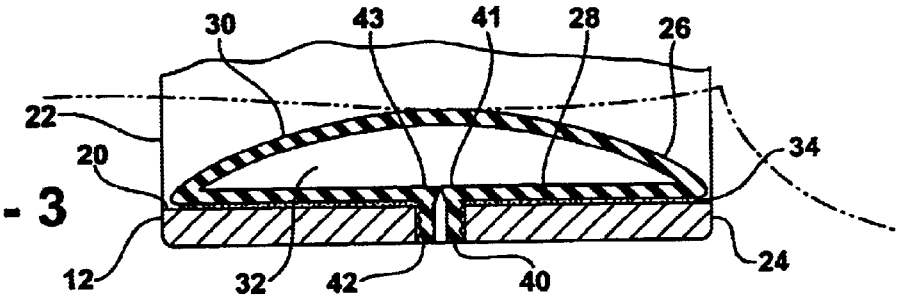
FIG - 3
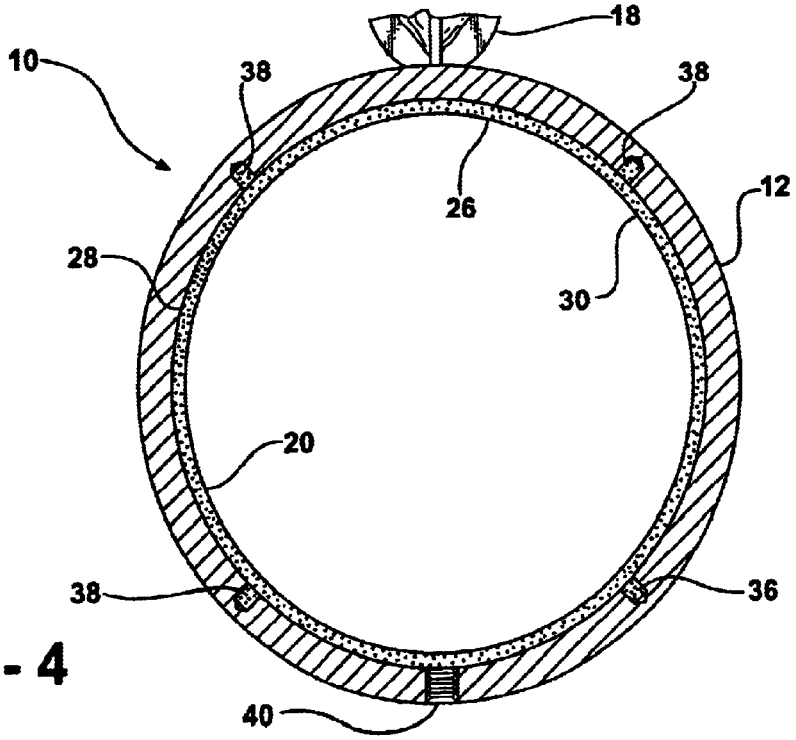
FIG - 4

FINGER RING FIT ADJUSTER

TECHNICAL FIELD

The finger ring fit adjuster permits a finger ring to be slid onto a finger and over a knuckle and then adjust to a snug fit.

BACKGROUND OF THE INVENTION

Rings were worn on fingers before recorded history. The problems concerning fit that the first people to wear rings experienced are still with us today. These fit problems relate to initial fit of a ring when the ring is first acquired and changes in finger size with age. A child's finger grows longer and larger in diameter until the child becomes an adult. The fingers of an adult change as the adults weight changes. Injuries can also change finger size. The knuckle joint connecting the first phalanx to the second phalanx of each finger tends to increase in diameter with age. At the same time the diameter of the first phalanx and the tissue encasing the first phalanx tends to decrease in diameter with advancing age when weight remains substantially constant. When the knuckle joint is larger in diameter than the center portion of the first phalanx, finger rings are loose after they slide over the knuckle joint.

Finger rings that are a band with a uniform cross section can rotate about a finger when they are loose. Such rotation of a band is not generally objectionable as long as the rings do not fall off.

Most finger rings worn by people today have a shank portion that extends radially outward from the band and carries an ornamentation. Such shank portions are intended to face outwardly from the backside of the hand when the fingers are extended. Rotation of a finger ring with a shank portion tends to move the shank portion and ornamentation carried by the shank portion out of view. When the shank portion rotates to a position between two fingers, it may interfere with the ability to use the fingers and to grasp various objects. To reduce these problems, a person wearing a loose ring has to rotate the ring back to the desired orientation frequently.

Numerous devices have been employed to tighten a loose finger ring and prevent rotation relative to a finger. One of the simplest devices is a band of adhesive tape wrapped around a section of the ring band. The tape band reduces the diameter of the finger passage through the ring band however the finger passage diameter must remain sufficiently large to slide over a knuckle. The tape wrap works but is unattractive and requires frequent replacement. Various mechanical devices have been tried to tighten loose rings. One group of mechanical devices includes a wedge member that is moved into a position between an inside surface of the band and a finger. Mechanical devices include levers that pivot about an axis parallel to the ring finger passage and into the finger passage through a ring. Some of these levers are spring biased. Springs and levers are expensive to manufacture, generally require substantial modification of the ring, and require maintenance.

Resilient pads have also been proposed to prevent rotation of finger rings relative to a finger. These pads require some machining of the ring, require a ring to be larger in diameter than normal, are difficult to adjust and tend to collect dirt and oils and require frequent cleaning. Resilient pads can be compressed slightly to slide over knuckles. However, such pads may have an adhesive coating that resists ring rotation and also resists passage of a knuckle.

Devices to adjust finger ring diameters are not readily available for purchase. Although the need for such devices is well known, none of the devices developed in the past appear to have found substantial acceptance.

SUMMARY OF THE INVENTION

The finger ring fit adjuster adjusts the fit of a finger ring band having a band inside surface that is generally cylindrical and forms a finger passage. A tubular bladder, for adjusting the size of the finger passage includes an outside wall that is anchored to the band inside surface. An inside wall is integral with the outside wall and cooperates with the outside wall to form a gas chamber. A passage connects the gas chamber to a source of air.

BRIEF DESCRIPTION OF THE DRAWINGS

The presently preferred embodiment of the invention is disclosed in the following description and in the accompanying drawings, wherein:

FIG. 1 is a perspective view of a finger ring with a ring fit adjuster;

FIG. 2 is an expanded perspective view of a ring and a ring fit adjuster;

FIG. 3 is an enlarged sectional view taken along line 3—3 in FIG. 1 with the gas chamber inflated;

FIG. 4 is an enlarged sectional view through the ring band only in a plane transverse to the finger passage axis;

DETAILED DESCRIPTION OF THE PREFERRED EMBODIMENT

Figure 5:
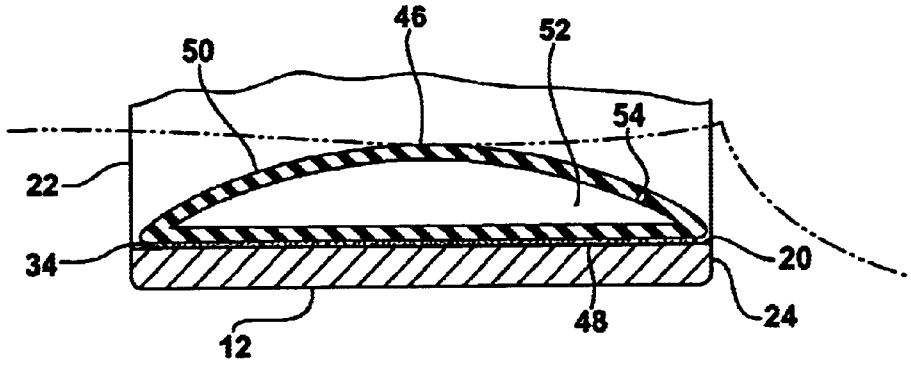
FIG. 5 is a view similar to FIG. 3 of a modified version of the invention.

The finger ring 10 includes a band 12. The band 12 can be metal or other material with sufficient strength and rigidity. The usual materials for finger rings 10 include silver, gold and platinum. The finger ring 10 includes the band portion 12 and a shank portion 14.

Figure 6:
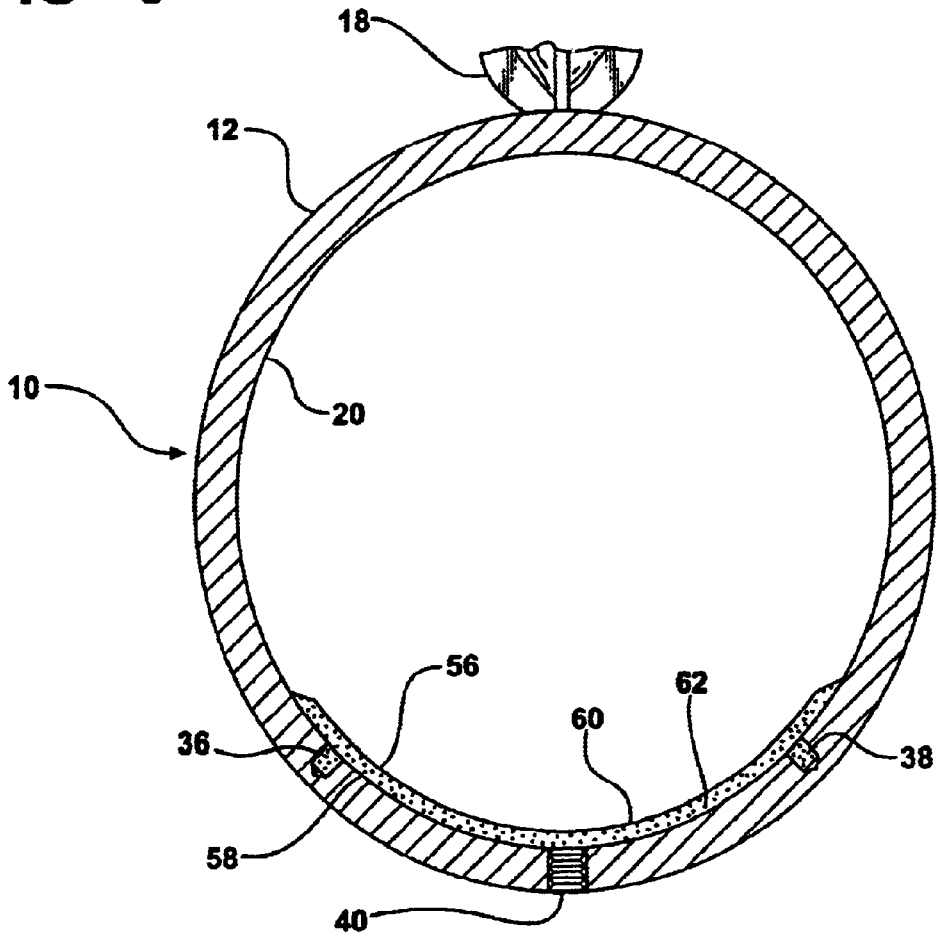
FIG. 6 is a view similar to FIG. 4 of another modified version of the invention.

The shank portion 14 shown in FIG. 2 extends slightly radially outward from the band portion 12 and holds a small cut diamond 16 as shown in FIG. 2. The shank 18 shown in FIGS. 4 and 6 is larger and extends radially outward further from the band portion 12 than the shank portion 14 shown in FIG. 2. Large shanks 18 can hold large precious or semi-precious stones or other ornamentation (not shown).

The band inside surface 20 is a cylindrical surface, as shown in the drawings, with a central axis. This surface 20 can also be slightly convex between the front edge 22 and the rear edge 24 of the band 12.

The finger ring adjuster 26 is a tubular bladder with an outside wall 28 and an inside wall 30 that is integral with the outside wall. The outside wall 28 as shown in FIGS. 1, 2, 3 and 4 is secured to the inside surface 20 and extends 360° about the inside surface. The inside wall 30 cooperates with the outside wall 28 to form a gas chamber 32 that extends 360° around the finger passage as shown in FIGS. 1, 2 and 4.

The outside wall 28 of the finger ring adjuster 26 is preferably fixed to the band inside surface 20 by an adhesive 34. By using an adhesive 34 no machining of the band portion 12 is required to hold the ring adjuster 26 in place. However, small radially extending bores 36, drilled into the band 12, can receive radial projection 38 on the outside wall 28, to hold the ring adjuster 26 in place or to supplement the adhesive 34. The outside wall 28 can also be anchored to the band portion 12 by the shape of surfaces on the band and the outside wall 28 that contact each other.

A finger ring adjuster 26 is a plastic material film that is flexible and resilient. Due to the thin wall thickness, it requires a minimal space in a radial direction. As a result, the band 12 does not have to be much larger than a persons normal ring size to accommodate the ring adjuster 26. The surface of the inside wall 30 that contacts a person's finger has a low coefficient of friction so that it is easy to slip on and off a person's finger. If desired the surface can be provided with small knobs, projections or grooves that permit some air to circulate in the space between the inside wall 30 and a person's finger. The surface of the inside wall 30 that contacts a person's finger can, if desired, include a material with a higher coefficient of friction to reduce movement between a person's finger and the ring.

An air valve 40 is provided in the outside wall 28 of the finger ring adjuster 26 as shown in FIGS. 1–4. The air valve 40, as shown, is a duck bill type valve that is closed by air pressure in the gas chamber 32. The valve 40 has flaps 41 and 43 that are opened by a small hollow needle (not shown) similar to the needles employed to inflate balls used in various athletic games. The needle is used to inflate the gas chamber 32 and to let air out of the chamber. Sufficient air can be forced into the gas chamber by blowing on the needle. Air valves 40 other than duck bill valves can be used. Due to the resilience of the adjuster 26, the inside wall 30 can be compressed by a person's finger to increase the diameter of a finger passage and permit the insertion of a knuckle through the band 12. After the knuckle passes through the band 12, the air pressure in the gas chamber 32 expands the finger ring adjuster to decrease the diameter of the finger passage and provide a snug fit.

The air valve 40 passes through a bore 42 through the band 12 that is spaced from the shank 14 or 18. The air valve 40 can be relatively small if a miniature needle is employed to add as well as remove air from the gas chamber 32.

The finger ring adjuster 46 shown in FIG. 5 is a modified version of the finger ring adjuster 26 shown in FIGS. 1–4. The air valve 40 shown in FIG. 3 has been eliminated. Elimination of the air valve eliminates the need for a bore 42 through the band 12. An outside wall 48 of the modified ring adjuster 46 is secured to the inside surface 20 of the band 12 the same as the outside wall 28 as described above. The inside wall 50 of the finger ring adjuster 46 is formed with a bias toward the shape shown in FIG. 5. An air chamber 52 is expanded when there is no external load on the inside wall 50 and the pressure of air inside the air chamber is the same as atmospheric air pressure. When a person inserts a finger into the finger passage, the inside wall 50 is forced to collapse some. A portion of the air in the air chamber 52 is forced out of the air chamber through one or more vent apertures 54 connecting the air chamber 52 to atmospheric air. After a finger knuckles passes through the finger passage through the finger ring adjuster 46, the internal bias formed in the inside wall 50 will decrease the diameter of the finger ring bore passage and keep the inside wall in contact with the finger in the passage. The decrease in the diameter of the finger bore passage increases the volume of the air chamber 52 and causes air to enter the air chamber through the vent aperture or apertures 54. When air pressure inside the air chamber 52 is equalized with atmospheric air pressure, the force of the internal bias in the finger ring adjuster 46 is the force exerted on the finger of a person wearing the finger ring.

The finger ring adjusters 26 and 46 extend 360° along the band inside surface 20 to form continuous air chambers 32 and 52. Finger rings 10 that require a small adjustment in the diameter of the band inside surface 20 can employ a finger ring adjuster 56 with a tubular bladder that extends less than 360° about the inside surface as shown in FIG. 6. The finger ring adjuster 56 has an outside wall 58 that extends a little more than 90° along the band inside surface 20. An inside wall 60 is integral with the outside wall 58 and cooperates with the outside wall to form a chamber 62 that is an arc of about 90° from end to end. The length of the walls 58 and 60 can be changed as desired to increase or decrease the length of the tubular bladder of the finger ring adjuster 56. Air can be forced in and out of the chamber 62 the same way it is forced in and out of the chamber 32 by providing a valve 40 as described above. Air can also move in or out of the chamber 62 by providing at least one vent aperture 54 as described above and forming the inside wall 60 with an internal bias that will tend to increase the area of the air chamber 62.

Figure 7:
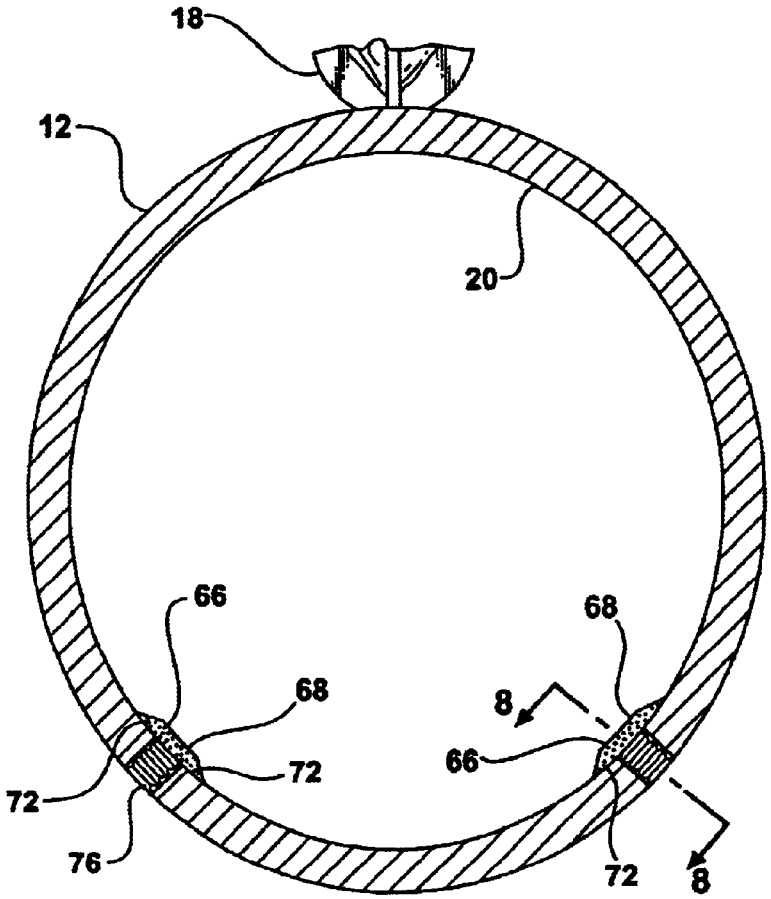
FIG. 7 is a view similar to FIG. 6 showing a ring fit adjuster with multiple small bladder elements.
Figure 8:
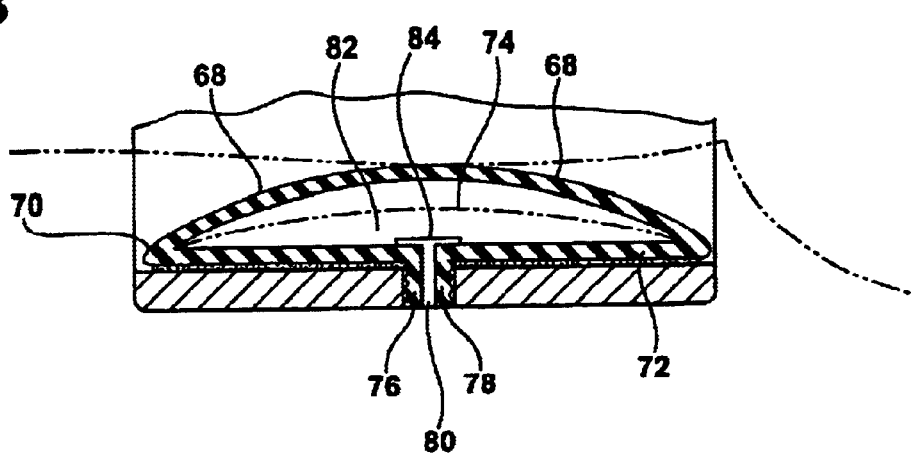
FIG. 8 is an enlarged sectional view taken along line 8—8 in FIG. 7.

The finger ring adjusters 26, 46 and 56 described above can be replaced by one or more finger ring adjusters 66 as shown in FIGS. 7 and 8. These finger ring adjusters 66 have an inside wall 68 with a generally circular outer periphery 70. An outside wall 72 joins the inside wall 68 along a line 74. An air valve 76 is connected to the outside wall 72 and passes through a bore 78 through the band 12. An air passage 80 through the air valve 76 extends from outside the ring band 12 through the ring band and to an air chamber 82. A resilient membrane 84 covers the passage 80 to hold air in the chamber 82. The membrane 84 opens to let air into the chamber 82 when an air pressure is applied to the passage 80. Air is forced out of the air chamber 82 when excess pressure is applied to the inside wall 68. Due to the relatively small size of the adjuster 66 pressure can be applied to force air from the air chamber 82 by a finger tip. Two finger ring adjusters 66 are shown in FIG. 7. In some cases one of the adjusters would be sufficient. In other cases more than two of the adjusters 66 may be required.

The air pressure opened valve 84 in the finger ring adjuster 66 can be replaced by the valve 40 shown in FIG. 3, by the air passage 54 shown in FIG. 5 or by another suitable valve. The air pressure opened valve 84 could also be used in place of the valve 40 or the air passage 54 as described above.

The finger ring adjusters have been described as having an inside wall and an outside wall that form air chamber 32, 52, 62 or 82. These finger adjusters can have inside walls and outside walls that are made of the same material and are one unitary construction. The finger ring adjusters can also be formed from multiple sections. A three piece tubular bladder could for example have an outside wall of relatively rigid material, an inside wall that joins the outside wall along one edge and an expandable wall that is connected to a second side of the outside wall and a second side of the inside wall. The expandable wall could be expandable because of its shape. The expandable wall can be expandable because of the material it is made from. The expandable wall can also expand more than other portions of a bladder due to the reduced thickness of a resilient material.

The disclosed embodiments are representative of a presently preferred form of the invention, but is intended to be illustrative rather than definitive thereof. The invention is defined in the claims.

What is claimed is:

1. A finger ring fit adjuster comprising:

a finger ring with a band having a band inside surface that is generally cylindrical and forms a finger passage, a band first end surface that surrounds a first finger passage opening and a band second end surface that surrounds a second finger passage openings a tubular bladder for adjusting the size of the finger passage, including an outside wall that is anchored to said band inside surface and an inside wall integral with the outside wall and cooperating with the outside wall to form a gas chamber extending less than 360° around the ring finger passage;

at least one passage connecting the gas chamber to a source of air; and wherein both the first finger passage opening and the second finger passage opening are a selectable finger receiving opening.

2. A finger ring fit adjuster, as set forth in claim 1, including a valve, connected to the at least one passage, that is opened to let air into or out of the gas chamber and that is closed to maintain a selected quantity of air in the gas chamber.

3. A finger ring fit adjuster, as set forth in claim 1, wherein the gas chamber extends more than 60° around the ring finger passage.

4. A finger ring fit adjuster, as set forth in claim 1, wherein the at least one passage is connected to air at atmospheric pressure.

5. A finger ring fit adjuster, as set forth in claim 4, where the inside wall is made from a resilient material that urges the gas chamber to expand to a predetermined size.

6. A finger ring fit adjuster, as set forth in claim 1, including a plurality of said tubular bladders each of which extends less than 360° around the ring finger passage.

7. A finger ring fit adjuster, as set forth in claim 1, including a plurality of said tubular bladders fixed to said band inside surface and separated from each other.

8. A finger ring fit adjuster comprising;

a finger ring with a ring band, and a band inside surface that is generally cylindrical and forms a finger passage with a fixed diameter;

a tubular bladder including a continuous outside wall anchored to said band inside surface; and an inside wall that is integral with the outside wall and forms a continuous gas chamber that extends 360° around the ring finger passage, and wherein the inside wall is made from a resilient material that resists a decrease in the volume of the continuous chamber; and a continually open gas passage through the tubular bladder that connects the continuous gas chamber to atmospheric air pressure.

9. A finger ring fit adjuster comprising:

a finger ring with a ring band with a band inside surface that is generally cylindrical;

a plurality of tubular bladders anchored to said ring band, discretely spaced from each other along the ring band inside surface and each extending less than 360° around the ring finger passage; and wherein each of the plurality of tubular bladders has an air chamber and a passage connecting the air chamber to a source of air.

10. A finger ring fit adjuster, as set forth in claim 9, wherein the passage connecting each of the air chambers to a source of air includes a valve for controlling the flow of gas into and out of the air chamber.

11. A method of adjusting the fit of a finger ring with a ring band having a finger passage comprising:

attaching a bladder to a finger passage wall of the ring band;

inflating the bladder with a selected quantity of air;

inserting a finger with a finger knuckle through the finger passage;

compressing the bladder as the finger knuckle passes through the finger passage;

expanding the bladder after the finger knuckle passes through the finger passage;

compressing a first phalanx of the finger with the bladder employing sufficient force to resist rotation of the finger ring relative to the first phalanx.

12. A method of adjusting the fit of a finger ring, as e set forth in claim 11, including adding air to the bladder to reduce the size of the finger passage.

13. A method of adjusting the fit of a finger ring, as set forth in claim 11, including:

removing air from the bladder to increase the size of the finger passage.

14. A finger ring fit adjuster comprising:

a finger ring with a band having a band inside surface that is generally cylindrical and forms a finger passage;

a tubular bladder for adjusting the size of the finger passage, including an outside wall that is anchored to said band inside surface and an inside wall integral with the outside wall and cooperating with the outside wall to form a gas chamber;

at least one passage connecting the gas chamber to a source of air; and wherein the gas chamber extends less than 360° around the ring finger passage.

15. A finger ring fit adjuster comprising:

a finger ring with a ring band with a band inside surface that is generally cylindrical;

a plurality of tubular bladders anchored to said ring band and circumferentially spaced from each other along the circumference of the ring band inside surface; and wherein each of the plurality of tubular bladders has an air chamber and a passage connecting the air chamber to a source of air.

* * * * *